United States Patent [19]

Werych

[11] 3,948,494

[45] Apr. 6, 1976

[54] WALKING BEAM FURNACE

[75] Inventor: Ewald R. Werych, Elm Grove, Wis.

[73] Assignee: Sola Basic Industries, Inc., Milwaukee, Wis.

[22] Filed: Oct. 21, 1974

[21] Appl. No.: 516,190

[52] U.S. Cl. ..... 266/5 H; 198/219; 432/122

[51] Int. Cl.[2] ..... F27B 9/14

[58] Field of Search ..... 266/5 H; 198/218, 219; 432/122, 123

[56] References Cited

UNITED STATES PATENTS

| | | | |
|---|---|---|---|
| 1,906,092 | 4/1933 | Peterson | 266/5 H |
| 1,936,199 | 11/1933 | Koll | 266/5 H |
| 2,017,024 | 10/1935 | Cochran et al. | 266/5 H UX |
| 2,206,156 | 7/1940 | Bogart et al. | 198/219 |
| 3,544,094 | 12/1970 | Knaak | 266/5 H |
| 3,588,060 | 6/1971 | Hermaus | 432/122 X |
| 3,730,333 | 5/1973 | Wakabayashi et al. | 198/219 |
| 3,836,325 | 9/1974 | Nakamura et al. | 432/123 X |

*Primary Examiner*—Roy Lake
*Assistant Examiner*—Howard N. Goldberg
*Attorney, Agent, or Firm*—Smythe & Moore

[57] ABSTRACT

A walking beam furnace has an elongated hearth with a longitudinal slot, and a walking beam is positioned within the slot. The bottom edge of the walking beam is provided with a rack which is engaged by a plurality of crank lever pins which are pivoted in a manner to raise, move forward, and then lower the beam. The pins are actuated by a mechanism positioned on the top of the furnace and connected to the pins by means of vertical actuating arms on the sides of the furnace with the arms being connected to shafts on the bottom of the furnace. The crank lever pins are mounted on the ends of the shafts.

12 Claims, 12 Drawing Figures

FIG. 1
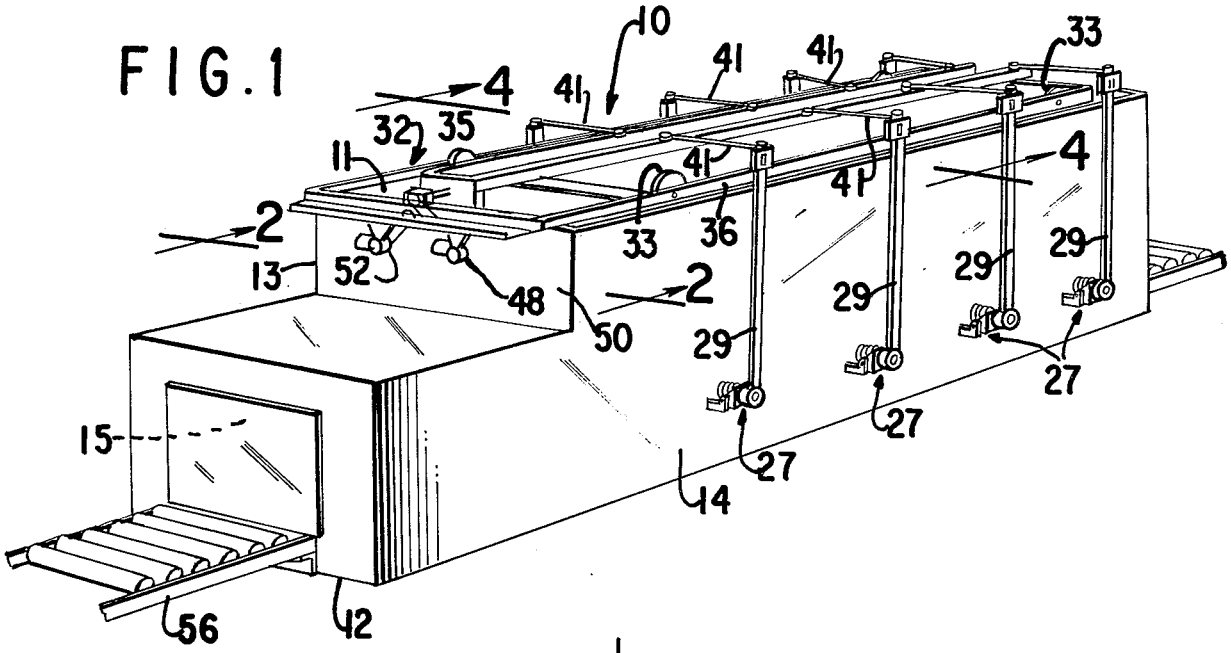
FIG. 2
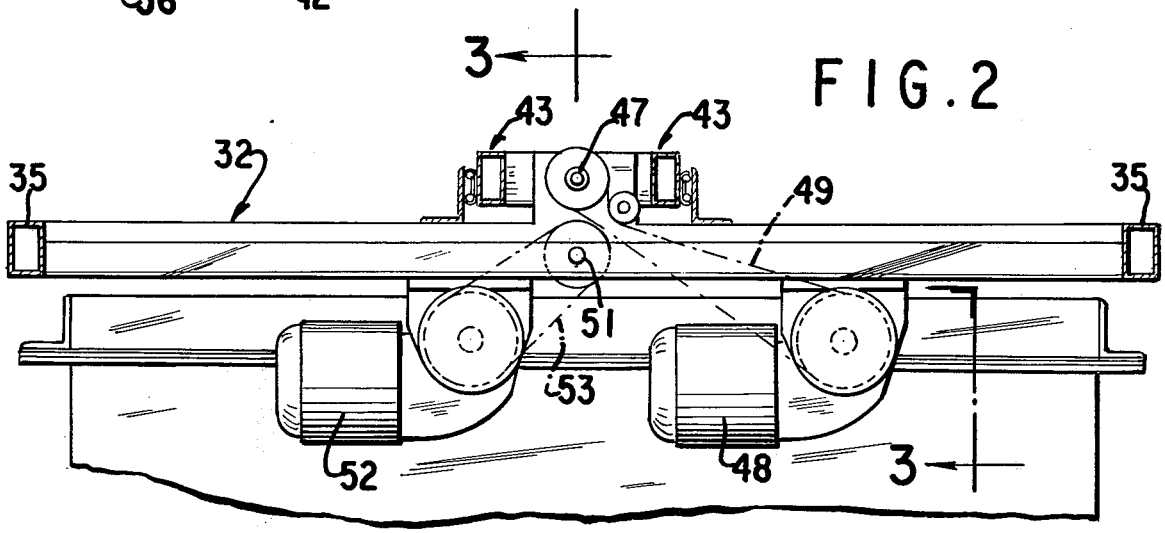
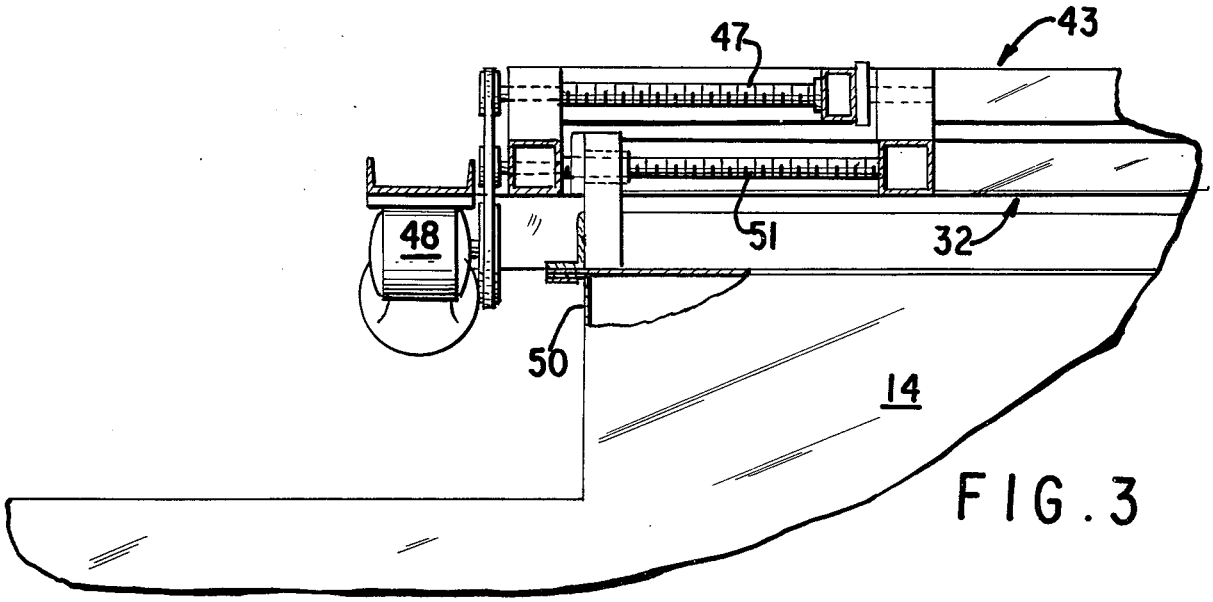
FIG. 3

FIG. 8
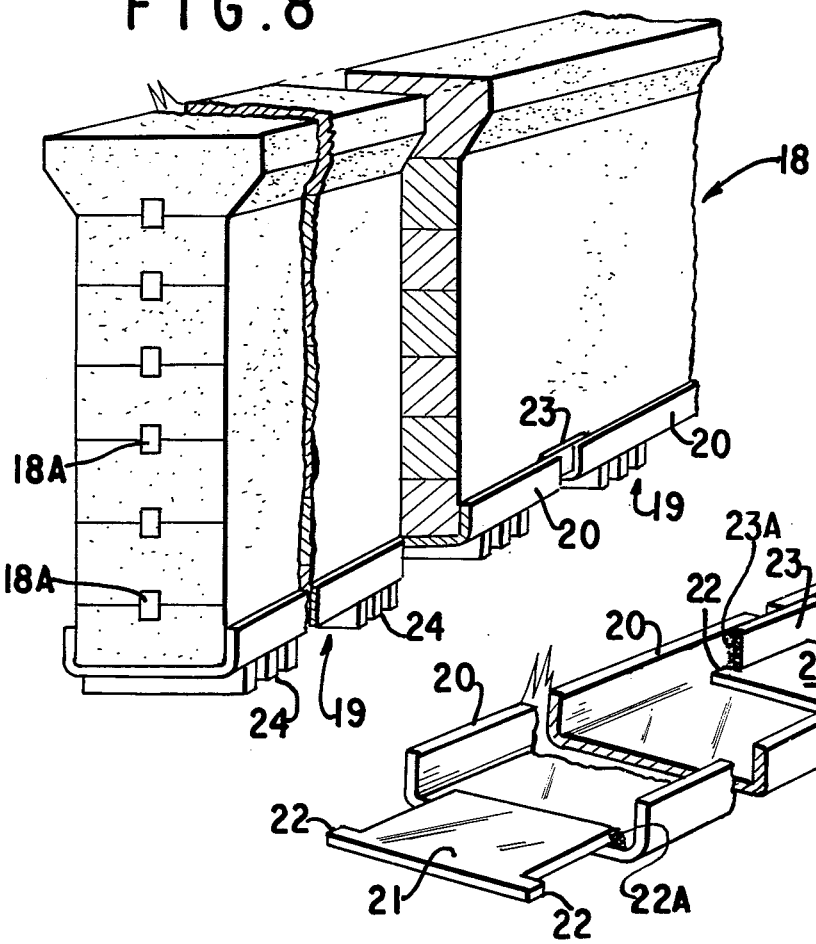
FIG. 9
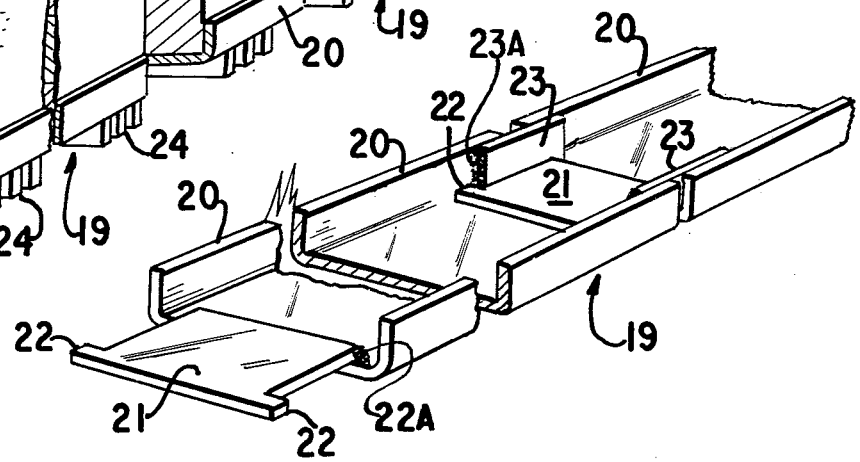
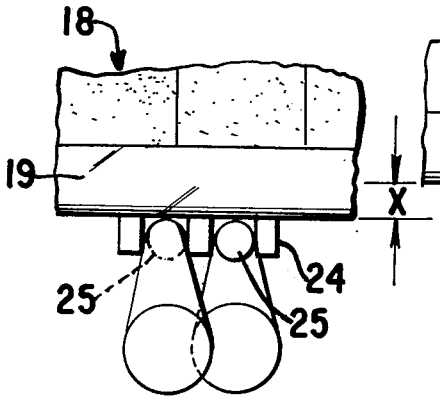
FIG. 10
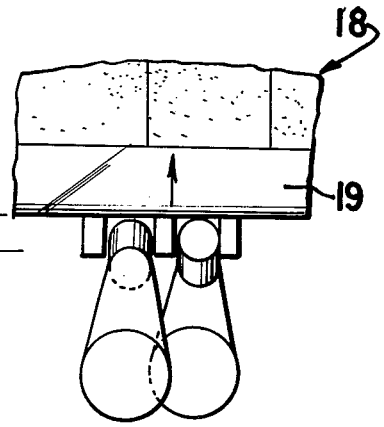
FIG. 11
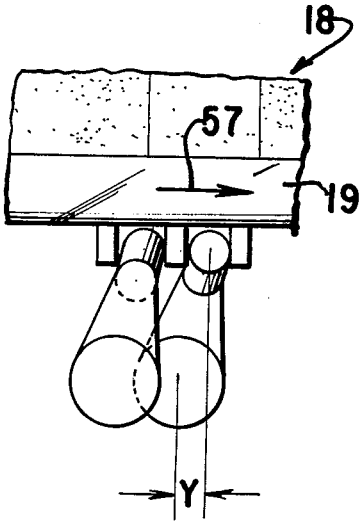
FIG. 12

WALKING BEAM FURNACE

The present invention relates to a walking beam furnace and, more particularly, to the mechanism for intermittently moving the walking beam relative to the hearth.

A walking beam furnace is one form of an industrial furnace which is used primarily in the heat treatment of metallic elements. In such a furnace, a beam is moved intermittently relative to the hearth to move the work pieces to be heat treated. The intermittent movement is generally provided by a cam and lever arrangement which operates to raise the walking beam slightly, move the walking beam forward a short horizontal distance, and then lower the walking beam into its resting position. This movement is continued at a regulated speed in order to convey the work pieces uniformly through the furnace at a predetermined rate.

Many forms of structures have been proposed for actuating the walking beams. Most of these structures have not been completely satisfactory in operation since the mechanism for operating the walking beam is mounted under the furnace where it is extremely hot and where access to the mechanism is difficult. In addition, the bottom of the furnace has a tendency to warp because of the heat vents therein which cause numerous atmospheric sealing problems. Further, the bearings which are located on the bottom of the furnace and used in the mechanisms for prior walking beam furnaces have been susceptible to these high temperatures and have been susceptible to rather frequent breakdowns. The susceptibility of these bearings to breakdown because of high temperature conditions and the relative inaccessibility to these bearings for maintenance purposes have combined to make such known walking beam actuating mechanisms not completely satisfactory.

One of the objects of the present invention is to provide an improved walking beam furnace.

Another of the objects of the present invention is to provide an improved mechanism for actuating the walking beam of the furnace.

Another of the objects of the invention is to provide a walking beam furnace wherein the mechanism for actuating the walking beam is located on the top and sides of the furnace and is operatively connected to the walking beam through a relatively small opening in the furnace wall.

According to one aspect of the present invention, a walking beam furnace may comprise an elongated hearth therein having a floor with a longitudinal slot in the floor. A walking beam is positioned within the floor slot and has an upper edge at the approximate level of the hearth floor and a bottom edge. Means are engageable with the bottom edge of the walking beam for intermittently raising, moving forward, and then lowering the beam. On the top of the furnace there are mounted means which are operatively connected to the intermittent means for actuating the intermittent means.

Other objects, advantages and features of the present invention will be apparant from the accompanying description and drawings, which are merely exemplary.

In the drawings:

FIG. 1 is an overall prospective view of a walking beam furnace incorporating the actuating mechanism of the present invention;

FIG. 2 is an end elevational view taken along the line 2—2 of FIG. 1 of the upper portion of the walking beam furnace showing the mounting of the drives thereon;

FIG. 3 is a sectional view taken along the line 3—3 of FIG. 2;

FIG. 8 is an overall perspective view of the walking beam with portions thereof being cut away to show the cross section of the beam;

FIG. 9 is an overall perspective view of the tray within which the beam is supported; and FIGS. 10–12, inclusive, are sectional views taken along the line 10—10 of FIG. 7 and showing various positions of the crank levers with respect to the bottom of the walking beam.

Proceding next to the drawings wherein like reference symbols indicate the same parts throughout the various views, a specific embodiment of the present invention will be described in detail.

Figure 4:
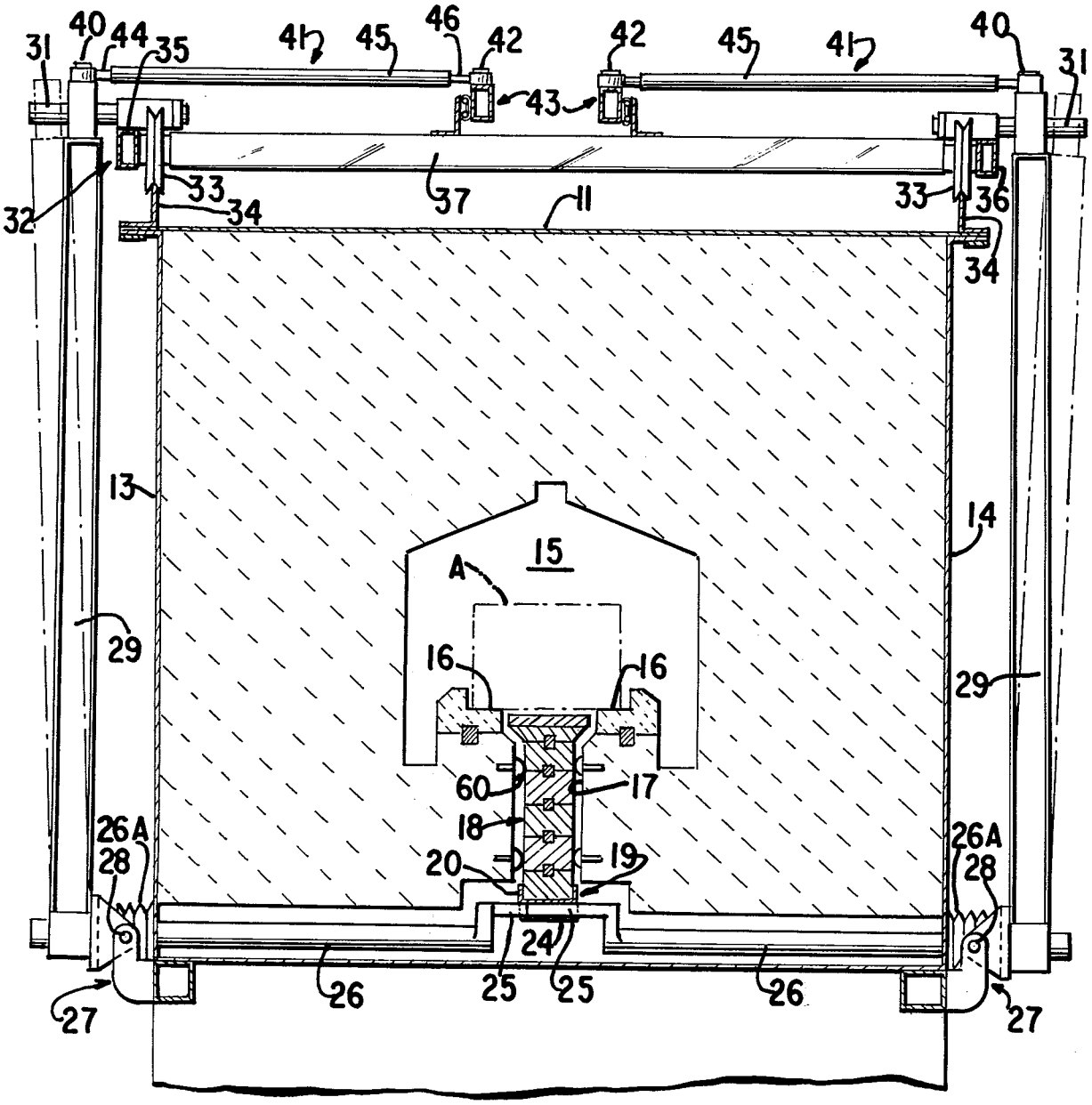
FIG. 4 is a sectional view taken along the line 4—4 of FIG. 1.

In FIG. 1, there is indicated generally at 10 a walking beam furnace having a top surface 11, a bottom surface 12, side surfaces 13 and 14, and an elongated tunnel or hearth 15 extending along the length of the furnace. As seen in FIG. 4, the elongated hearth is provided with a floor or supporting surface 16 through the center of which is positioned a longitudinal slot 17 in which is disposed a walking beam 18. The walking beam 18 is formed of a plurality of interlocking ceramic blocks as known in the art and shown in greater detail in FIG. 8. Key elements 18A may be used therein.

The walking beam 18 is supported in a tray 19 which is formed of a plurality of aligned interlocking tray elements 20. Each tray element 20 is provided with a longitudinally extending projection 21 which can be welded as at 23A to one end of an element 20. Each projection has lateral lugs 22. Retaining blocks 23 can be welded at 23A to the side walls of the other end of the element. The retaining blocks 23 will fit behind the lugs 22 of the following tray 20. Thus, the projection 21 is, in effect, an interlocking tab means which permits movement of the tray elements relative to each other and also aligns all of the tray elements in a straight line so as to carry the walking beam 18. The temperature on the ends of beam 18 is different from the temperature in the center thereof so that if the tray is formed of a single piece of metal of sufficient length of accommodate the beam, the metal would warp and buckle so as to throw the beam out of line. By constructing the tray of individual aligned tray elements, this problem is overcome.

On the bottom of each tray element there is provided a rack means 24.

Articles to be transported through the furnace can be placed in containers A (FIGS. 4, 7) or otherwise arranged so as to be moved through the furnace by being lifted upwardly by beam 18 and above floor 16 and then moved longitudinally by beam 18.

In order to walk the articles or containers A through the furnace, rack elements 24 are engageable by a plurality of crank pins mounted on shafts 26. Shafts 26 are rotatably or pivotally carried by blocks 27, shafts 26 being rotatable about an axis transverse to the walking beam. Blocks 27 are pivotally mounted on pins 28 and are pivotable about an axis parallel to the beam 18. Shafts 26 pass through bellows 26A which provide a seal for the aperture in the furnace walls through which shafts 26 pass. The bellows permit rocking action of blocks 27 relative to the furnace and seal the interior of the furnace relative to the outside at this zone.

Figure 5:
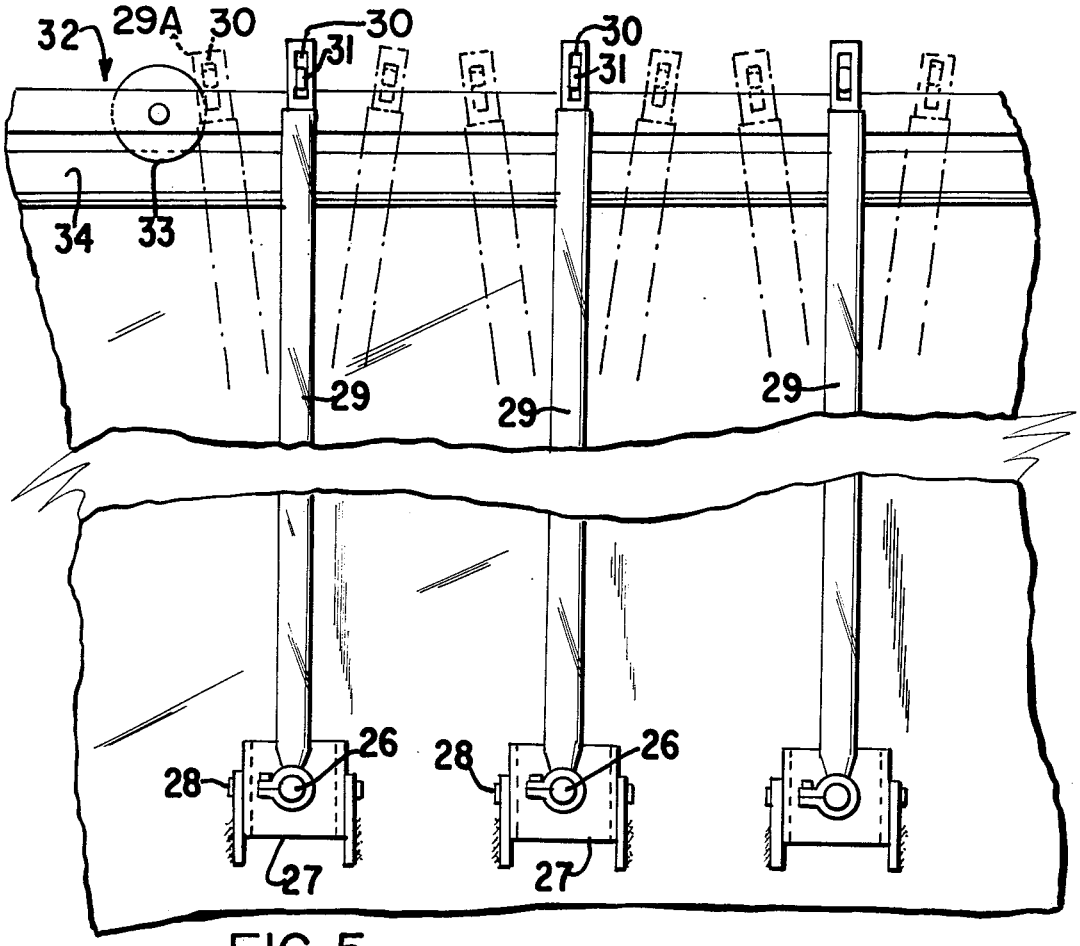
FIG. 5 is a side elevational view of a portion of the furnace of FIG. 1 and in somewhat enlarged scale.

Upstanding from the outer end of each shaft 26 is a vertical actuating arm 29 (FIGS. 1, 4, 5) which extends upwardly along the side walls 13, 14 of the furnace. The arm 29 extends upwardly beyond the top surface 11 of the furnace and the upper end 29A of each arm is provided with a vertically extending slot 30 (FIG. 5).

Slot 30 receives a pin 31 which extends outwardly from carriage 32 mounted on wheels 33 (FIG. 4) travelling upon rails 34 attached to the top surface 11 of the furnace so that the carriage 32 is capable of longitudinal reciprocable movement upon the top of the furnace. Carriage 32 comprises a pair of longitudinally extending members 35 and 36 which are interconnected by cross beams 37.

The upper ends of each of the actuating arms 29 are pivotally connected at 40 to tie rods 41 whose inner ends are pivotally connected at 42 to elongated motion transmitting members 43. Each of the tie rods 41 can comprise a shaft 44 onto which is threaded a tubular member 45 and has an inner shaft 46 similarly threaded in the other end of the tubular member 45. The shafts 44 and 46 are oppositely threaded so as to permit adjustment of the length of the transverse tie rods 41 and thus the amount of pivoting movement of the arm and shaft assembly 29, 26 in the manner to be presently described.

The members 43, to which the transverse rods 41 are connected, are operatively connected through a threaded shaft 47 to a drive motor 48 by means of a belt 49 with the drive motor 48 being mounted on carriage 32. The members 43 are reciprocable relative to the carriage. In a similar manner, the carriage 32 having longitudinal members 35, 36 is also connected through a threaded shaft 51 to a drive motor 52 by means of a drive belt 53 with the drive motor 52 being also located on the carriage 32.

Carriage 32 and the tie rod beam assembly 43 can be driven by ball screws but other drives, such as hydraulic, pneumatic or cables, could be used. A suitable drive would be any drive which would provide a horizontal movement to carriage 32 and members 43. While the present embodiment is shown with variable speed d. c. drives and mechanisms, any other type of control, a timer, or any other intermittent operation could be employed which would establish the speed at which it is desired to walk or move the workpieces through the furnace. This speed will depend on the number of actuations of the walking beam which are made per unit time. In the particular embodiment described herein, the walking beam is moved forward about ⅜ inch during each step since the movement of this magnitude does not require large openings in the furnace wall through which there would be a substantial heat loss.

Figure 7:
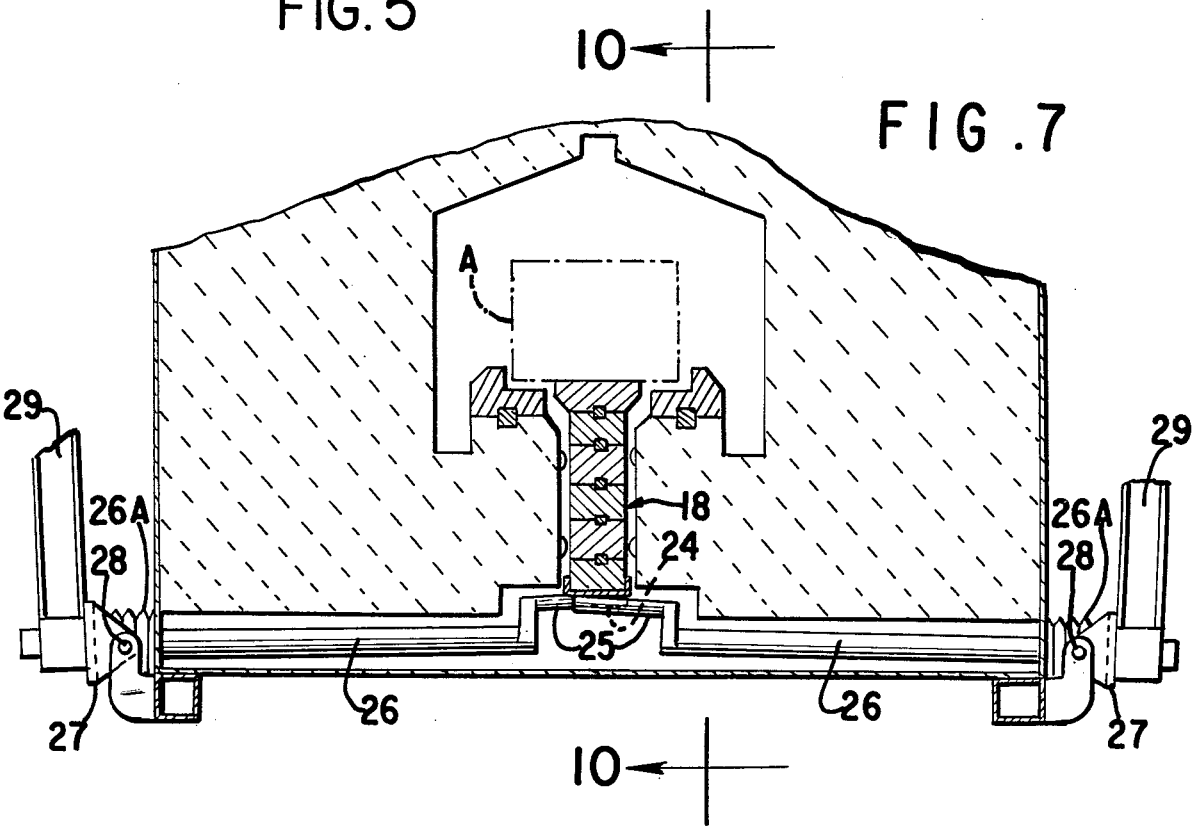
FIG. 7 is a view of the lower portion of FIG. 4 showing the walking beam in the raised position.
Figure 6:
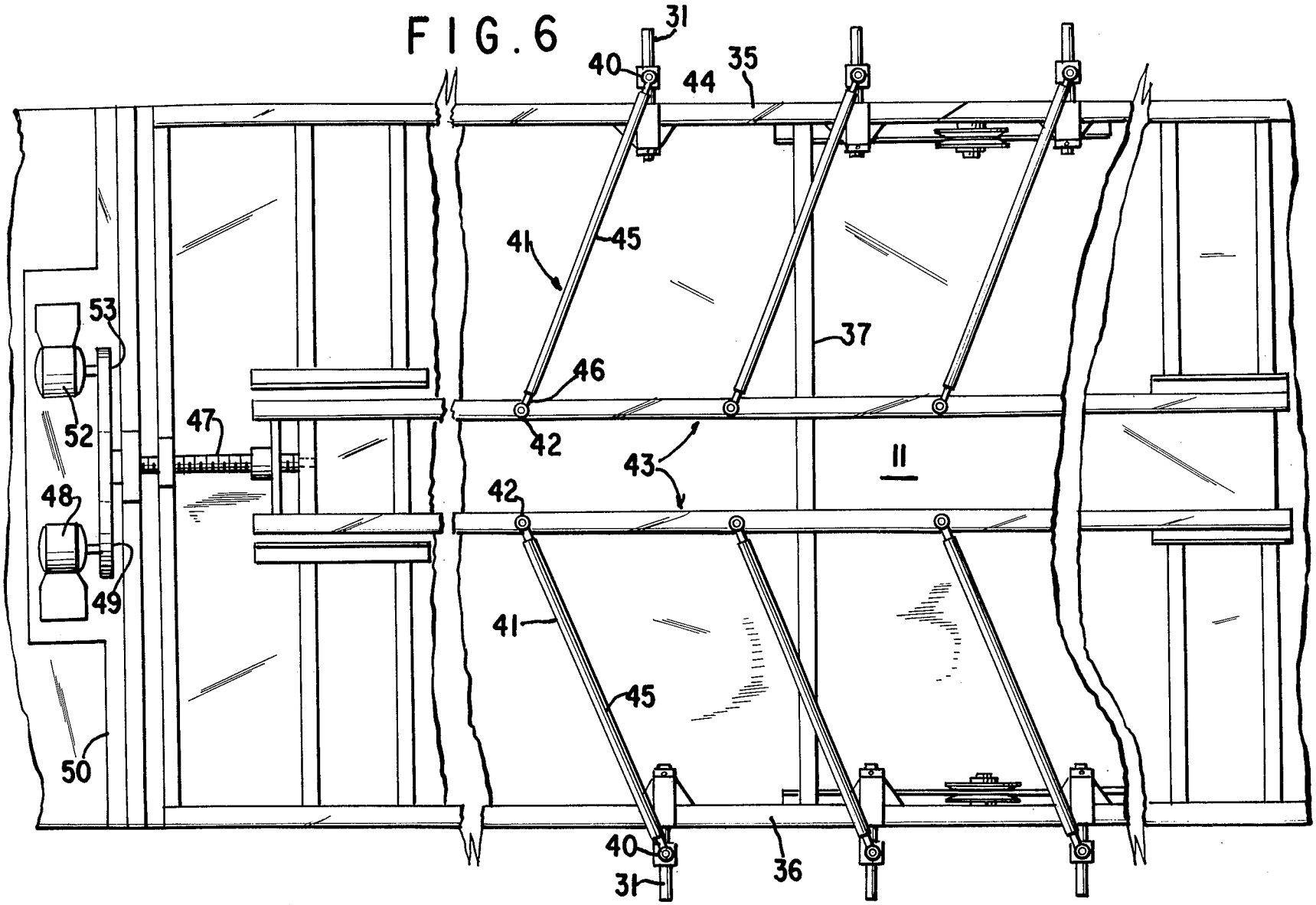
FIG. 6 is a broken top plan view of the actuating mechanism on the top of the furnace.

In the operation of the furnace in the heat treating process, the workpieces to be treated are placed in a container, such as a metal ceramic or cermet boat, shown in dashed lines at A, FIGS. 4 and 7. The container is first placed on a roller conveyor 56 (FIG. 1) which introduces the workpieces into the furnace and upon the floor 16 thereof. Other means to move the load into the furnace can be used.

Intermittent movement is imparted to the walking beam 18 by the crank lever pins 25 engaging the rack 24 on the bottom of tray 19 as shown in FIG. 10, which are rocked to elevate the walking beam the distance indicated by the arrows at X (FIG. 11). In the raised walking beam position, the crank lever pins are pivoted by movement of carriage 32 with beams 43 being motionless to move the beam forward in the direction of the arrow 57 a distance indicated at Y (FIG. 12). After the forward movement of the raised walking beam 18 and work carried thereby, the crank lever pins are then lowered as will be explained hereafter.

Movement of the crank lever pins 25 is obtained by the pivotal movement about two axes of the shafts 26. The longitudinal beam assembly 43 is actuated in a longitudinal direction relative to carriage 32 while the carriage 32 is stationary. Because of the pivotal connections at both ends of the tie rods 41 and since the tie rods have an overall length which is greater than the distance between the beam 43 and the respective arms 29 when in their vertical positions, the movement of the members 43 will cause the tie rods to pivot the arms 29 as shown in the dashed lines in FIG. 4 so that the arm and shaft assembly 29, 26 will be pivoted around the horizontal axis of pin 28. The pivotal movement about the horizontal axis of pin 28 brings about the raising and lowering of the crank lever pins, with respect to the rack 24. The pins are shown in their lowered positions in FIGS. 4 and 10 and in their raised positions in FIGS. 7 and 11. The carriage 32 is then moved in the forward direction by its motor, the beams 43 moving along with the carriage so that the walking beam will be moved forward as seen in FIG. 12. After completion of movement of the walking beam forward, beams 43 are moved backward with the carriage 32 motionless which will drop the walking beam to its lowered position. Carriage 32 then is moved backward with the walking beam in its lowered position and to its original position seen in FIG. 10.

As shown in FIG. 4, tungsten or suitable material pads 60 are provided at the opposed upper and lower portions of the slot 17 to provide bearing surfaces for beam 18. Since, in one embodiment, the beam can be of the order of about 14 inches in height, there may be a tendency for the beam to lean and, since the beam is moving relatively frequently, there is a possibility of the beam wearing out on the side walls of the slot 17. It is desirable to keep the space between the beam and the side walls as small as possible in order to prevent much heat loss.

It is, therefore, apparent that the present invention has provided an improved mechanism for actuating a walking beam of a walking beam furnace. The improvement generally resides in positioning the actuating mechanism on the upper and side walls of the furnace so that the mechanism is readily accessible at all times for service purposes and the various varying components of the mechanism are not subjected to the high temperatures generally found beneath the bottom wall of the furnace.

It will be understood that various details of construction and arrangement of parts may be made without departing from the spirit of the invention except as defined in the appended claims.

What is claimed is:

1. In a walking beam furnace, the combination of an elongated hearth having a floor with a longitudinal slot therein, a walking beam within said floor slot and having an upper edge at the approximate level of said hearth floor and a lower edge portion, means engageable with the lower edge portion of said walking beam for intermittently raising, moving forward, and lowering the beam, and means on the top of the furnace operatively connected to said means engageable with the lower portion of said walking beam means for actuating said means engageable with the lower portion.

2. In a walking beam furnace as claimed in claim 1 wherein said means engageable with the lower portion extends below the bottom and along the sides of the furnace.

3. In a walking beam furnace as claimed in claim 2 and including bellows seal means between said means engageable with the lower edge portion and the exterior of the furnace.

4. In a walking beam furnace as claimed in claim 1 and having rack means on the bottom edge of said beam, and a plurality of crank lever pins on said means engageable with the lower portion for engaging said rack means.

5. In a walking beam furnace as claimed in claim 4 and a plurality of shafts pivotally mounted under the bottom of said furnace and each shaft extending transversely from the side of the furnace to the bottom of said beam, a crank lever pin on each shaft and engageable with said rack means, a vertical bar attached at the outer end of each shaft, means for mounting each of said shaft and bar assemblies for pivotal movement along a respective horizontal axis transverse to the shaft at the vicinity of said bar attached to the shaft, and means on the top of the furnace for pivoting all of said arms and shafts both about said horizontal pivot axes and about the longitudinal axes of the shafts so that each crank lever pin will be raised into engagement with said rack means, pivot to move said rack horizontally, and then lowered to disengage from the rack.

6. In a walking beam furnace as claimed in claim 5 wherein said pivoting means comprises a carriage mounted for reciprocable longitudinal movement on the top of the furnace, means connecting said carriage and said vertical arms such that reciprocating movement of said carriage pivots said arms about the axes of their respective shafts, and means on the top of said furnace for pivoting said arms and shafts about their respective horizontal pivot axes.

7. In a walking beam furnace as claimed in claim 6 wherein said arm and shaft pivoting means comprises longitudinally reciprocating elongated means, and a plurality of tie rods pivotally connecting each of said arms with said elongated means such that reciprocating movement of said elongated means will pivot said arms and shafts about their respective horizontal axes.

8. In a walking beam furnace as claimed in claim 7 and first drive means on the furnace for reciprocating said carriage, and second drive means on the furnace for reciprocating said elongated means.

9. In a walking beam furnace as claimed in claim 8 wherein said drive means operate to reciprocate said carriage and elongated means in opposite directions.

10. In a walking beam furnace as claimed in claim 1 and a channel-shaped tray, said beam being supported within said tray.

11. In a walking beam furnace as claimed in claim 10 wherein said tray comprises a plurality of detachable interconnected aligned tray elements.

12. In a walking beam furnace as claimed in claim 11 and rack means on the bottom of said tray elements.

* * * * *